US006032435A

United States Patent [19]

Zaniboni

[11] Patent Number: 6,032,435

[45] Date of Patent: Mar. 7, 2000

[54] DEVICE FOR INTRODUCING SLEEVES INTO CASES FOR COMPACT DISC AND THE LIKE

[75] Inventor: Carlo Zaniboni, Castenaso, Italy

[73] Assignee: Gima S.p.A., Bologna, Italy

[21] Appl. No.: 09/072,539

[22] Filed: May 5, 1998

[51] Int. Cl.[7] ..... B65B 63/04

[52] U.S. Cl. ..... 53/117; 53/156; 53/157; 53/238

[58] Field of Search ..... 493/92, 167, 171, 493/174, 465, 965; 53/50, 117, 156, 157, 238, 254, 429, 474

[56] References Cited

U.S. PATENT DOCUMENTS

| | | | |
|---|---|---|---|
| 4,685,277 | 8/1987 | Ilsemann | 53/474 |
| 4,852,327 | 8/1989 | Kurkowski et al. | 53/254 X |
| 5,163,271 | 11/1992 | Pan et al. | 53/474 X |
| 5,207,050 | 5/1993 | Fulkerson et al. | 53/474 |
| 5,285,620 | 2/1994 | Kaye et al. | 53/474 |
| 5,341,624 | 8/1994 | Kaye | 53/238 X |
| 5,664,405 | 9/1997 | Perego | 53/564 X |
| 5,788,114 | 8/1998 | Perego | 53/468 X |
| 5,816,028 | 10/1998 | Zaniboni | 53/445 |

*Primary Examiner*—Daniel B. Moon

*Attorney, Agent, or Firm*—Nims, Howes, Collison, Hansen & Lackert

[57] ABSTRACT

A device for introducing sleeves into cases for compact discs and the like, includes an assembly for withdrawing each time a single sleeve from a storage device. The withdrawing assembly transfer the sleeves to a feeding surface, substantially horizontal, in the region of a line for feeding these sleeves to further processing devices. An inserting head with gripping means for keeping the sleeve fed to the feeding surface, and with folding rollers for folding two edges of the sleeve over fold-around pieces, takes over and inserts the sleeve into an underlying case. The inserting head is moved between a sleeves gripping position and a position in which it inserts the sleeve in the case, that is in open configuration on a conveyor.

6 Claims, 7 Drawing Sheets

FIG. 4b
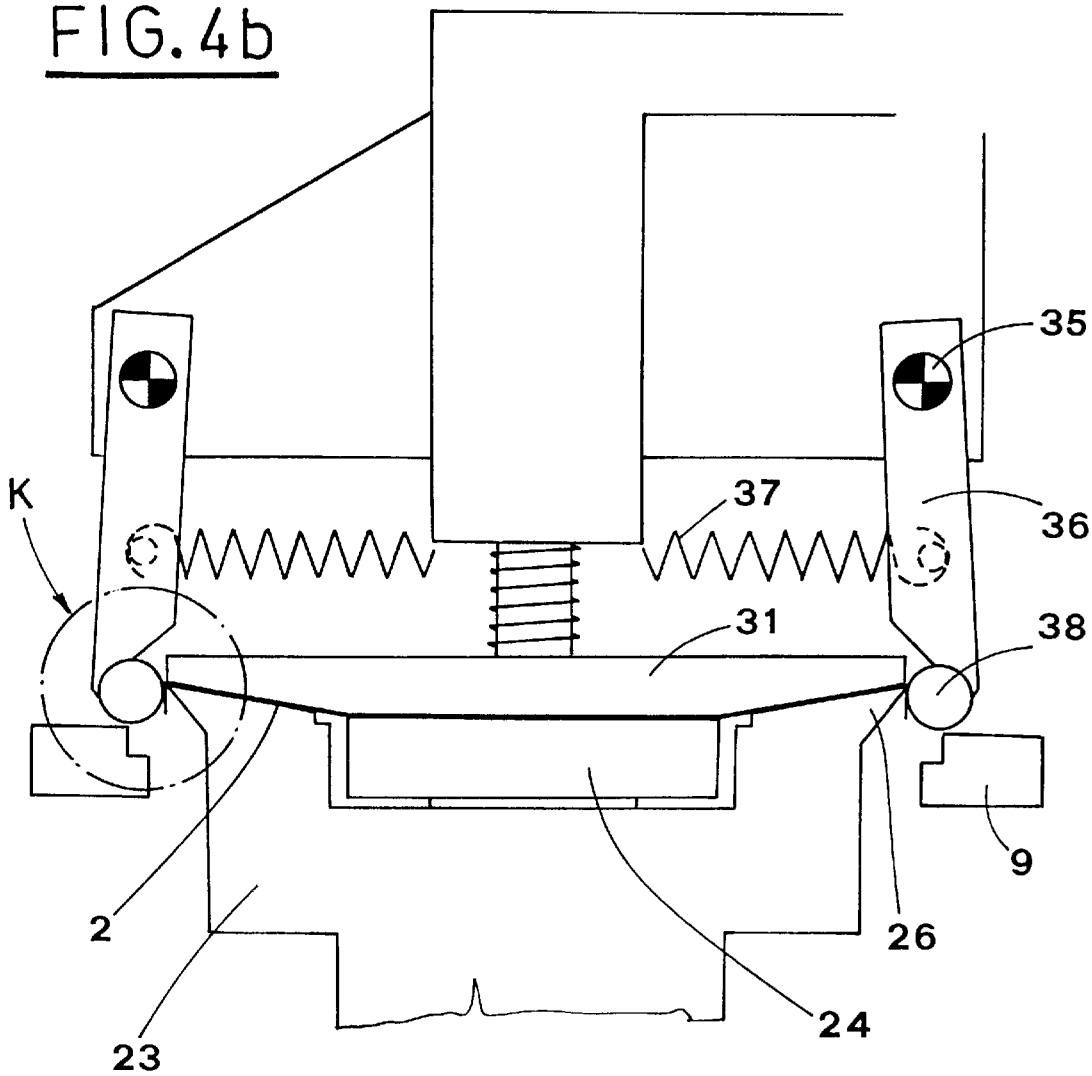
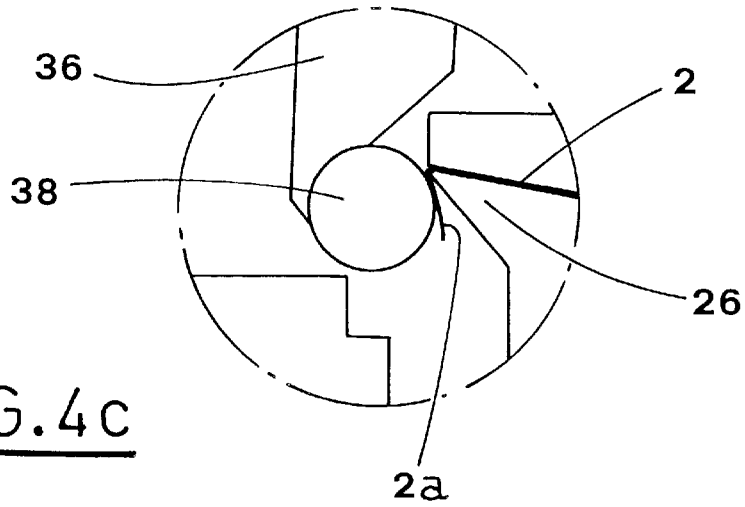
FIG. 4c

DEVICE FOR INTRODUCING SLEEVES INTO CASES FOR COMPACT DISC AND THE LIKE

FIELD OF THE INVENTION

The present invention relates to packaging of compact discs or the like inside relative cases. More precisely, the invention concerns a device for introducing sleeves into the cases for compact discs, the device being mounted on the machines for packaging these compact discs.

DESCRIPTION OF THE PRIOR ART

Compact discs, widely known as CDs, are usually packed inside cases formed by two shells of plastic material, usually transparent, hinged together along a common edge.

A first shell is made in form of a box and forms the base fo the case. An insert is placed inside the box-like shell and is provided with means for elastically locking the CD.

A second shell, of shape complementary to the shape of the box-like shell, forms a cover for the case.

A sleeve, e.g. with information about contents of the compact disc printed on the surface turned outside, is placed on the bottom of the case, before the above mentioned insert is assembled.

Along two opposite sides, the sleeve has folded edges, which adhere to corresponding sides of the case.

Sleeve introduction into the cases is usually difficult with the known devices mounted on the machines for packaging the CDs.

In fact, it is necessary to place precisely the sleeve inside the case, so as to avoid defective results.

SUMMARY OF THE INVENTION

The object of the present invention is to propose a device which introduces a sleeve precisely into a case for a compact disc or the like, in a machine for packaging compact discs, so as to simplify the production cycle and to increase production capacity.

The above mentioned object is obtained in accordance with the contents of the claims, by means of a device for introducing a sleeve into a case for compact discs and the like, the case being formed by a pair of shells having complementary shape and hinged together, which are fed, in open configuration, along a conveying line, said device including:

- withdrawing means for withdrawing a single sleeve from a storage device and for transferring said single sleeve to a substantially horizontal feeding surface located in the region of said sleeves feeding line;
- sleeve inserting means equipped with at least one head carrying gripping means which grip said sleeve fed at said feeding surface, and fold-around means around which opposite lateral edges of said sleeve are folded, with said inserting means rotating between a sleeve gripping position, situated in the region of said feeding surface, and an inserting position in which said sleeve is inserted into a relative case carried along said conveying line.

BRIEF DESCRIPTION OF THE DRAWINGS

The characteristic features of the invention will be pointed out in the following description of a preferred, but not limitative embodiment, with reference to the enclosed drawings, in which:

FIGS. 4*a* and 4*b* are detailed section views, taken along the plane IV—IV of FIG. 3*b*, of means for distributing sleeves, in subsequent operating steps;

FIG. 4*c* is an enlarged view of particular K of FIG. 4*b;*

DESCRIPTION OF THE PREFERRED EMBODIMENT

Figure 1:
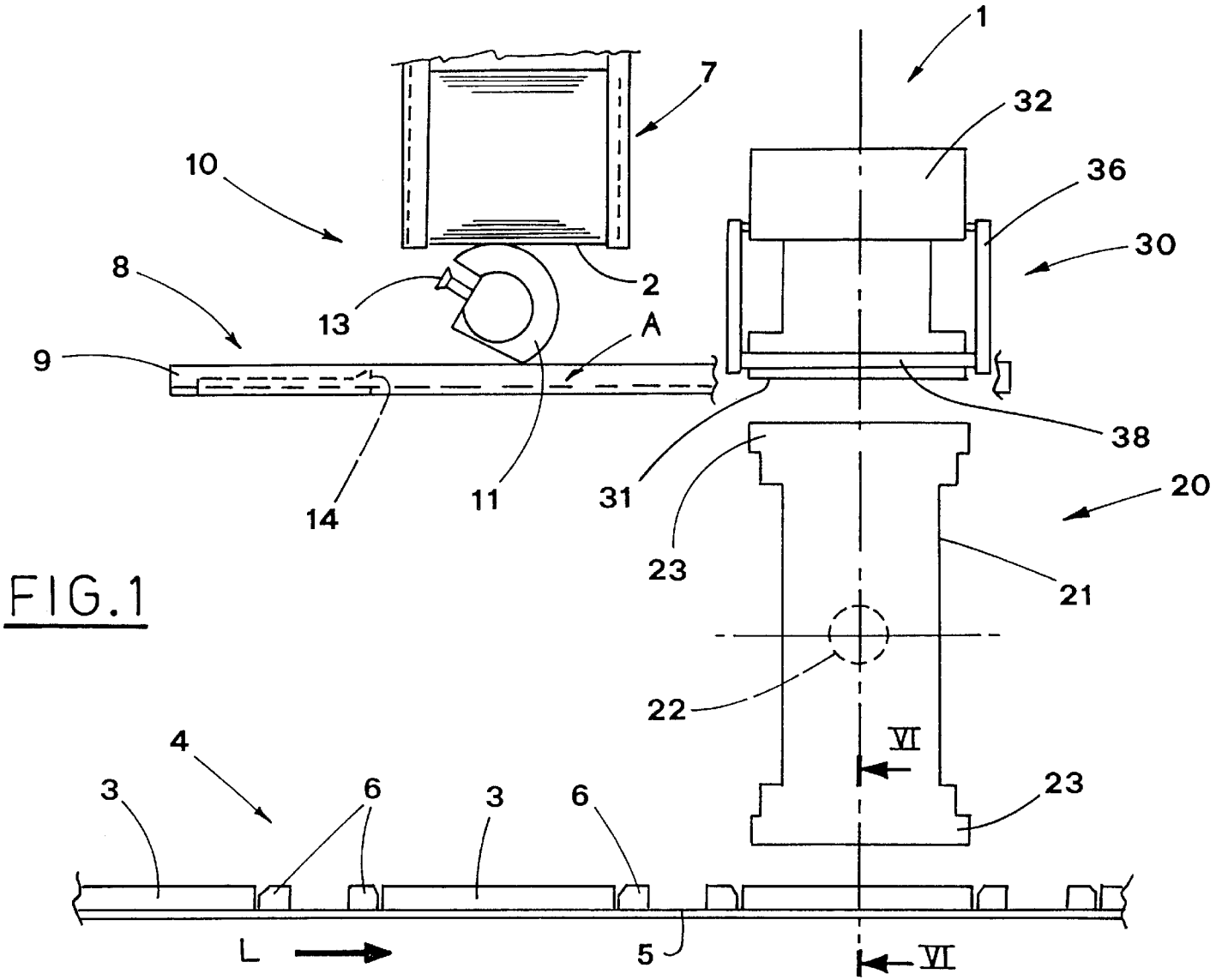
FIG. 1 is a schematic lateral view of the proposed device for introducing sleeves into cases for compact discs.

With reference to the above mentioned figures, numeral 1 indicates a device for introducing sleeves 2 into cases 3. The sleeve introducing device is to be mounted on a machine for packaging CDs and the like in the cases.

The cases are formed by two shells of complementary shapes, hinged together along a common edge.

The cases 3 are fed in open configuration along a conveying line 4, operated intermittently in the direction indicated with the arrow L.

The conveying line 4 is formed by a pair of conveying belts 5, arranged side by side, which feature a series of crosspieces 6, suitably spaced apart and aimed at defining corresponding seats for the cases 3 to be conveyed.

The device 1 includes a withdrawing group 10 for withdrawing each time a single sleeve 2 from a storage device 7, where the sleeves 2 are stacked.

The group 10 transfers the sleeves 2 to a feeding surface A, substantially horizontal and situated in the region of a feeding line 8.

The feeding line 8 is defined by a pair of guides 9, arranged side by side, which support the opposite edges of the sleeves 2.

The feeding line 8 is situated over the cases 3 conveying line 4 and is parallel thereto.

The withdrawing group 10 is formed by a roller 11, in fact a cylindrical sector, which is translated and rotated below the storage device 7 holding the sleeves 2.

The roller 11 rotates about a horizontal axis crosswise to the feeding line 8 and can translate with reciprocating motion in a direction longitudinal to this feeding line 8.

In practice, the roller 11 rolls on the surface of the lowermost sleeve 2 of the stack in the storage device 7.

As a matter of fact, the element 11 is formed by a series of rollers mounted, arranged side by side, on a shaft 12.

A series of suction cups 13, which are connected to suitable sucking means, protrude in radial directions from the shaft 12, in the regions of the rollers.

A pusher 14, moving along the feeding line 8, transfers the sleeve 2 withdrawn by the roller 11, onto the feeding surface A.

A supply group 20 for distributing sleeves 2 to respective cases 3 fed along the conveying line 4, is situated downstream of the withdrawing group 10, along the feeding line 8.

The supply group 20 includes an element 21 which is carried rotatably on a central pin 22 having a horizontal axis transversal to the lines 4 and 8.

Figure 6A:
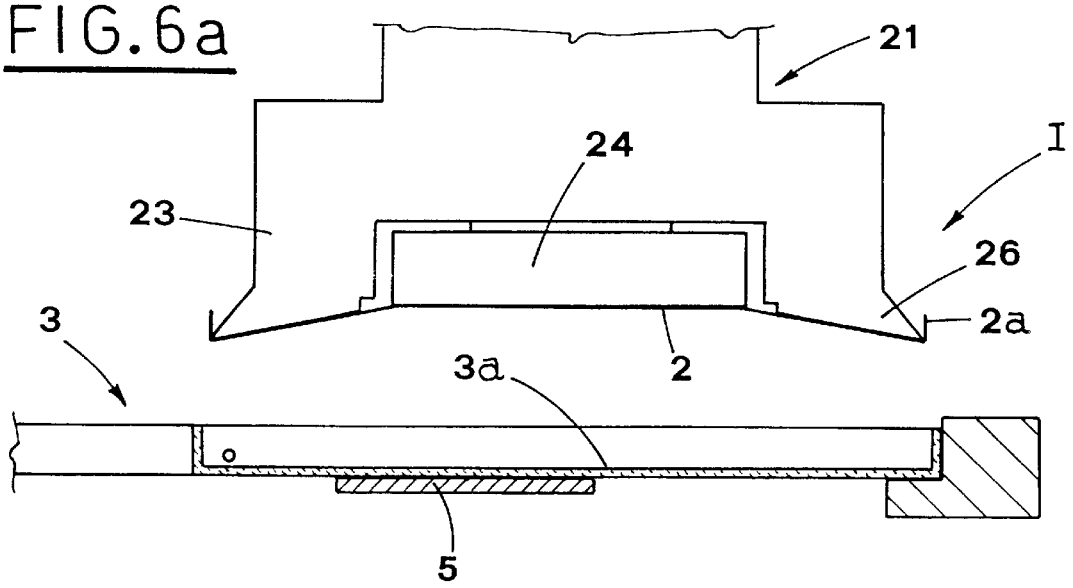
FIGS. 6*a*, 6*b* and 6*c* are section views, taken along the plane VI—VI of FIG. 1, of the above mentioned distribution means during subsequent steps in which a sleeve is introduced into a relative case.
Figure 6B:
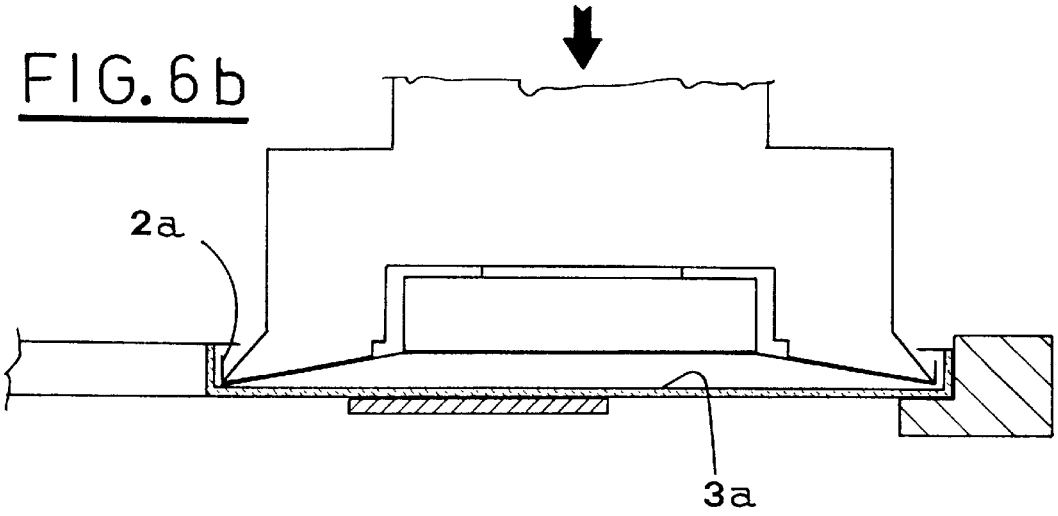

The element 21 rotates between a position P, in which the sleeves 2 are gripped in the region of the feeding surface A (FIG. 3*b*), and a position 1, in which these sleeves 2 are introduced into relative cases 3 carried on conveying means 4 (FIG. 6*a*).

The rotating element 21 is also moved vertically, with reciprocating motion, by known and not shown actuators.

At its opposite ends, the rotating element 21 features a first and a second working heads 23, identical to each other, which alternatively withdraw a sleeve and introduce it into a relative case 3.

Each head 23 of the rotating element 21 features a gripping member 24 which moves along a longitudinal axis of this rotating element 21.

The gripping member 24 is equipped with a series of openings 25, which are to be connected to suitable sucking means.

On the sides opposite to the gripping member 24, the head 23 features a pair of fold-around pieces 26, substantially formed by blade-like portions protruding outwards from the head 23.

The fold-around pieces 26 serve to fold the opposite lateral edges of the sleeve 2, as will be explained later.

It is to be noted that these fold-around pieces 26 are slightly inclined, lowering toward the plane defined by the gripping member 24.

Figure 4A:
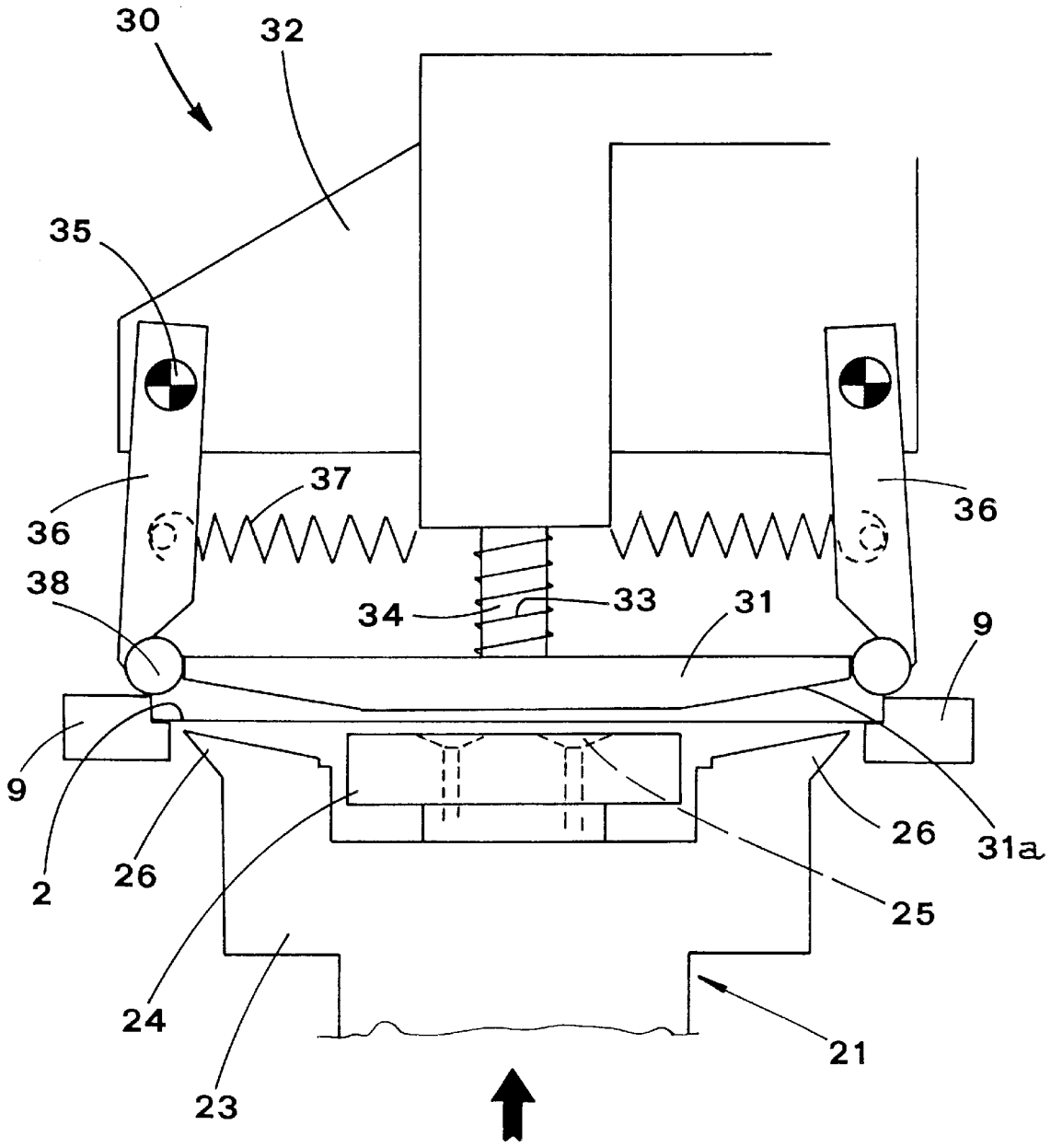

The head 23 and the rotating element 21 cooperate with a stop group 30, situated over the distribution group 20 (FIGS. 4*a*, 4*b*).

The stop group 30 includes a plate 31 carried, sliding along a vertical axis, by a stationary body 32.

The plate 31 is guided on the body 32 by a stem 34, along which a spring 33 extends to push elastically on this plate 31.

On its front surface, the plate 31 forms lateral sections 31*a* inclined according to a profile matching the profile defined by the upper surface of the fold-around pieces 26 and the gripping member 24 of the head 23.

The body 32 carries also a first and a second pair of symmetric arms 36, hinged on relative pins 35 having horizontal axes longitudinal to the feeding line 8.

The arms 36 are connected to each other by a return spring 37.

On their free end, the arms 36 carry respective rollers 38, which cooperate with the above mentioned fold-around pieces 26.

The sleeves 2 to be introduced into the cases 3 are withdrawn by the withdrawing group 10 acting below the storage device 7.

The roller 11 of this withdrawing group 10 rolls on the surface of the lowermost sleeve 2 of the pile stacked in the storage device 7, removing it therefrom (FIG. 1).

Figure 2A:
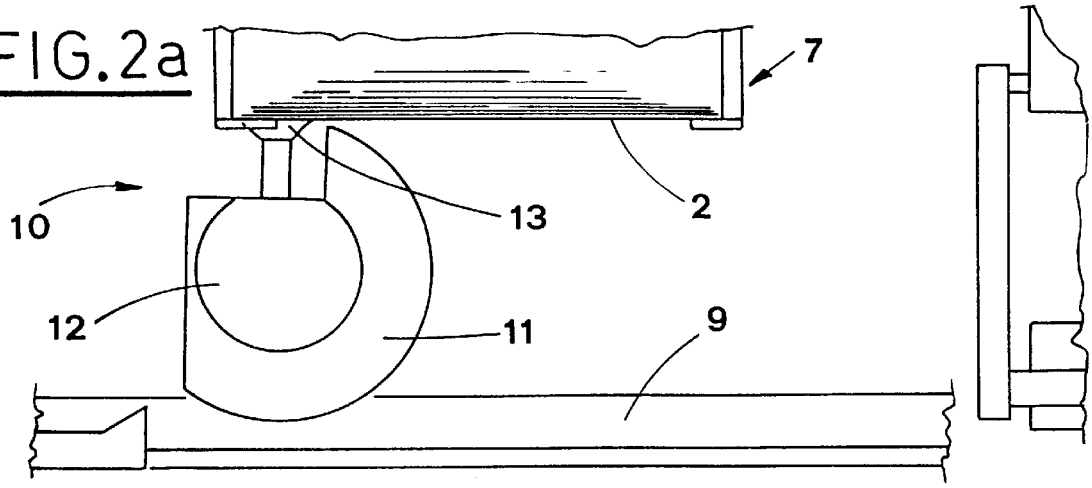
FIGS. 2*a*, 2*b* and 2*c* are lateral views of a detail of means provided for withdrawing single sleeves, respectively in different working steps.

More precisely, in an initial working position, seen in detail in FIG. 2*a*, the suction cups 13 of the roller 11 grip an edge of the above mentioned sleeve 2.

The rotation-translation movement imposed to the roller 11 determines removal of the sleeve 2 from the storage device 7.

Figure 2B:
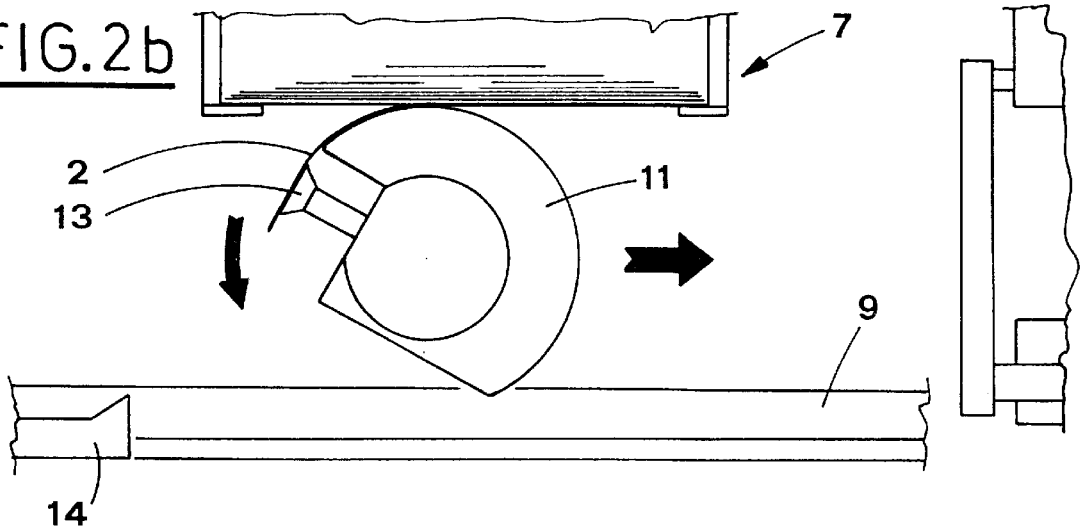

In this step, the withdrawn sleeve 2 adheres to the roller 11 (FIG. 2*b*), following its shape.

Figure 2C:
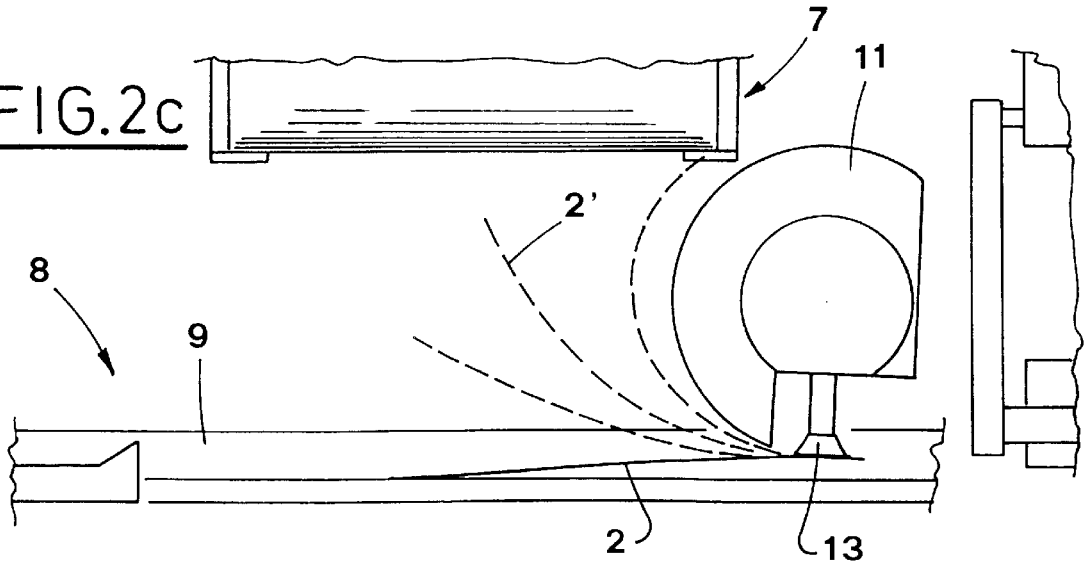

When the roller 11 advancement step is completed, the sleeve 2 is overturned on the feeding line 8, as indicated with broken lines 2', and is released by the suction cups 13 remaining supported on the guides 9 of the line 8 defining the feeding surface A (FIG. 2*c*).

Figure 3A:
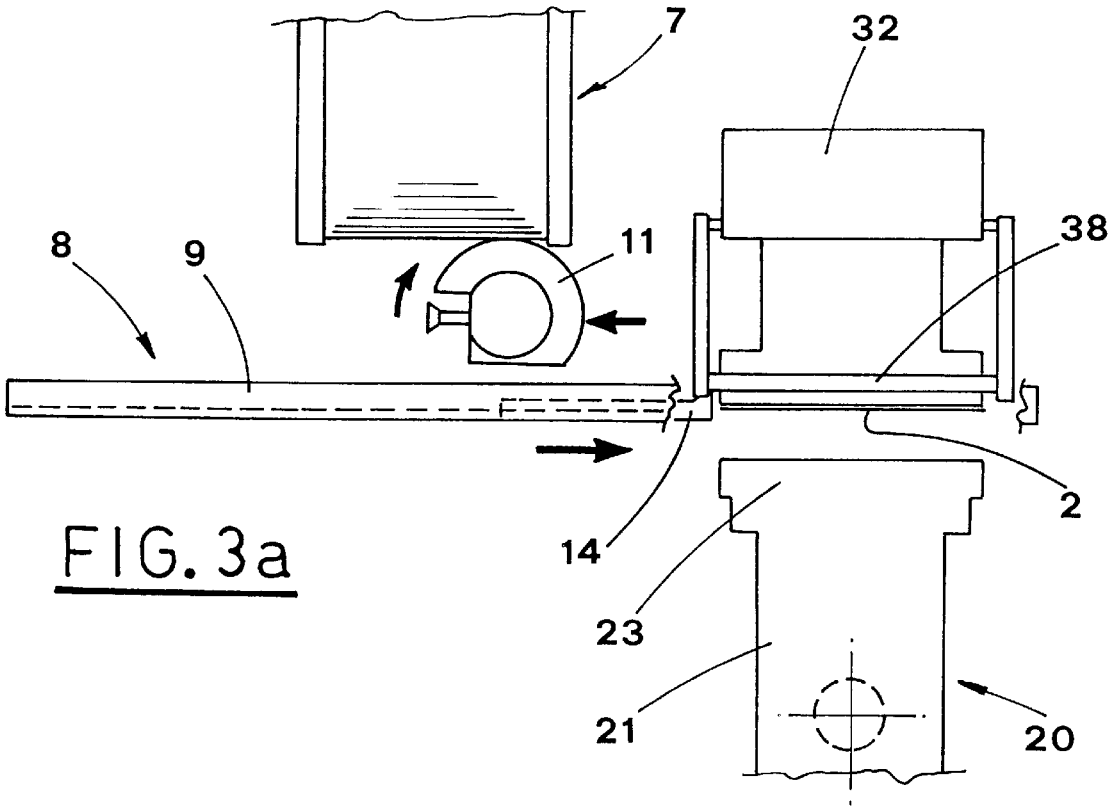
FIGS. 3*a* and 3*b* are partial schematic views of the device, in subsequent steps for withdrawing a sleeve.

At this point, the pusher 14 is operated, so as to transfer the withdrawn sleeve 2 to the supply group 20, while the roller 11 performs a return stroke to the initial working position, so as to withdraw a subsequent sleeve (FIG. 3*a*).

During this transfer step, the sleeve 2 is supported by the guides 9 of the feeding line 8, extending below the stop group 30.

Figure 3B:
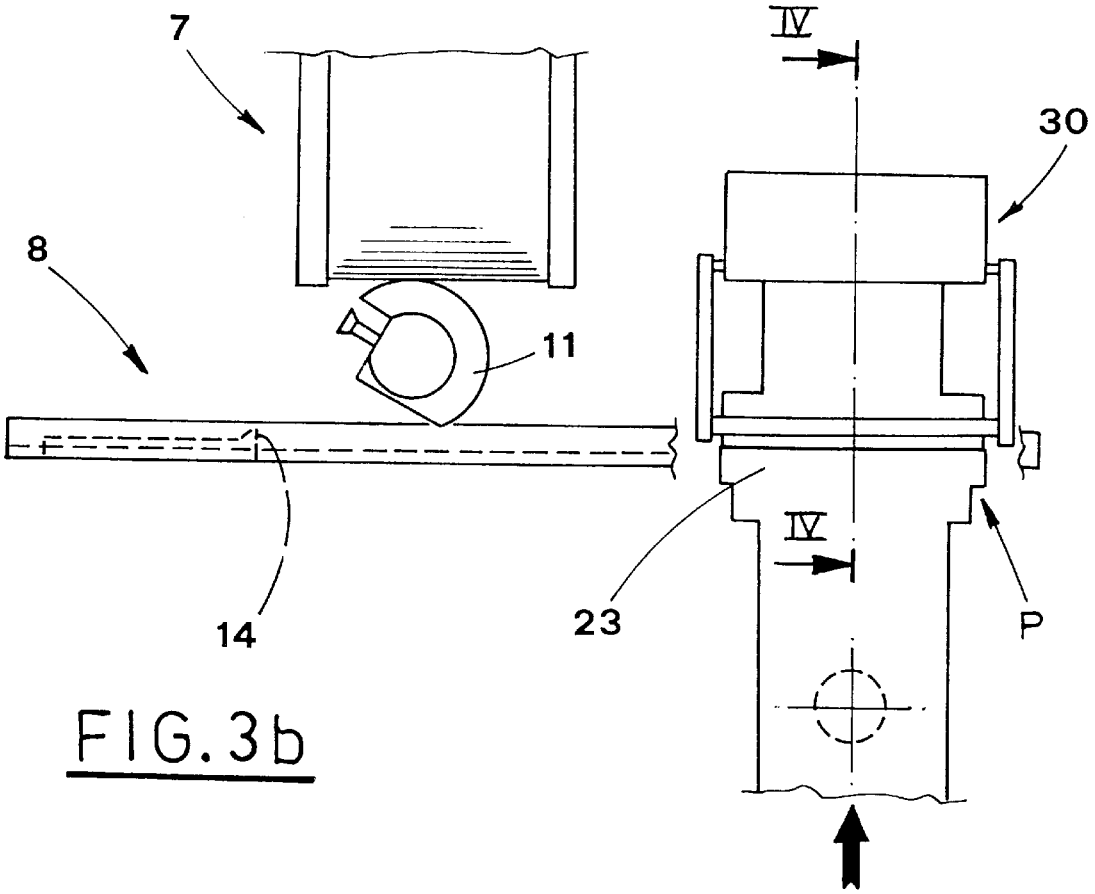

Then, the rotating element 21 of the distribution group translates vertically to the sleeve 2 gripping position P, so as to bring the head 23 to cooperate with the stop group 30 (FIG. 3*b*).

More precisely, as seen in detail in FIG. 4*a*, during this translation step, the rotating element 21 is arranged vertically in the gripping position P and its gripping member 24 is in out off-set position, i.e. it protrudes axially from the head 23, so as to grip the sleeve 2.

This out off-set position of the gripping member 24 is obtained by the openings 25 being set in under-pressure condition.

Then, the member 24 gripping the sleeve 2, is moved to the retracted position inside the head 23.

In this configuration, the rotating element 21 of the supply group 20 is further translated vertically, until it engages the stop group 30, so as to tighten elastically the sleeve 2 against the plate 31 sprung by this stop group 30 (FIG. 4*b*).

During this step, the lateral sides 2*a* of the sleeve 2, protruding from the opposite sides of the head 23, are folded.

These edges 2*a* are folded by rollers 38 carried by the arms 36 which oscillate in contrast with elastic action of the return spring 37.

In fact, the rollers 38 fold the edges 2*a* of the sleeve 2 against the outer side of the fold-around pieces 26 (see the enlarged particular in FIG. 4*c*).

It is to be noted that the sleeve tightened between the head 23 and the plate 31 takes a flared profile corresponding to the profile of the plate 31.

Figure 5:
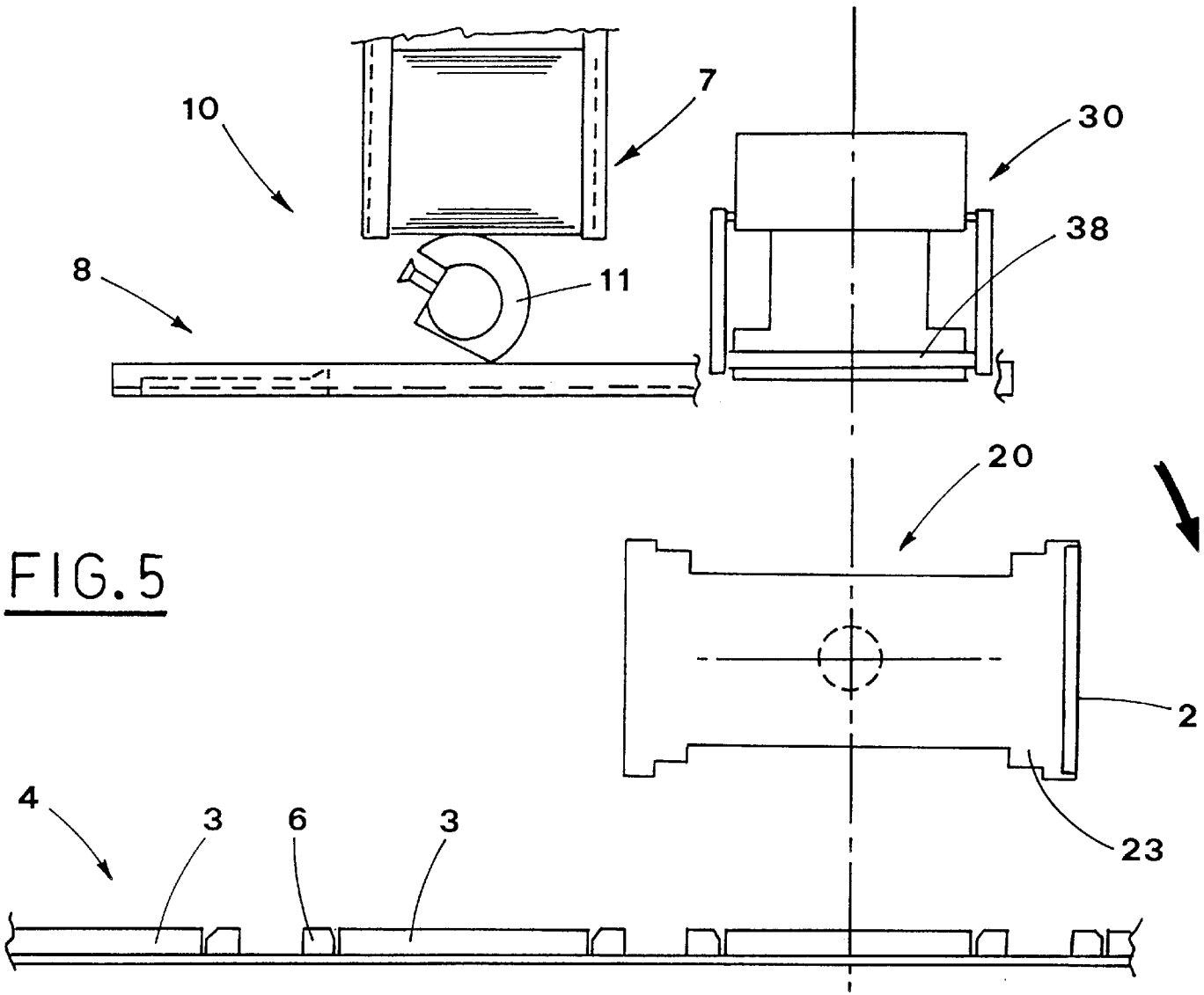
FIG. 5 is a schematic view of the device during an intermediate step for distribution of the sleeves.

The rotating element 21 of the supply group 20 is subsequently translated downward, so as to be separated from the stop group 30 and then it rotates, substantially over a half-circumference angle, so as to bring the head 23 gripping the folded sleeve 2 to the position I in which the sleeve is introduced into a relative case 3 (FIG. 5).

More precisely, when the rotating element 21 has completed its rotation in the introduction position I, the head 23 carrying the sleeve 2 is vertically aligned with a relative shell 3*a* of the cases 3, which receives this sleeve 2 (FIG. 6*a*).

Then, the rotating element 21 is vertically translated, so as to bring the head 23 to a position, in which it engages the shell 3*a* of the case 3 situated below (FIG. 3*b*); the flared profile assumed by the sleeve 2 facilitates the introduction.

Figure 6C:
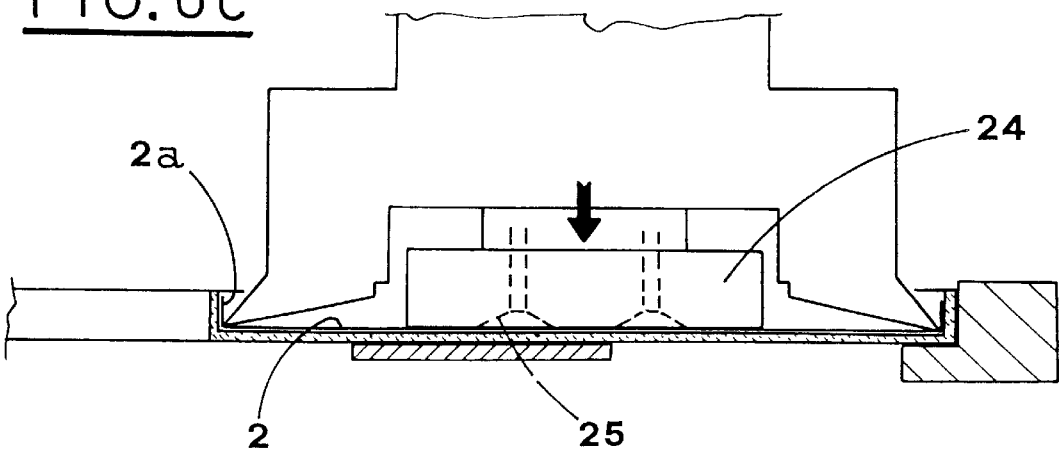

The subsequent movement of the gripping member 24 to the out off-set position releases the sleeve 2 inside the shell 3*a* (FIG. 6*c*).

The introduction of the sleeve 2 into the case 3 is preferably helped by a blow of air emitted by the gripping member 24, by e.g. reversing the air flow through the openings 25.

Consequently, the described device obtains the object of achieving a precise introduction of a sleeve into a case for compact discs in machines for packaging the compact discs.

The device allows also to simplify the production cycle and to reduce the working time.

Obviously, the two heads on the rotating element of the distribution group allow to increase the working speed, by combining the introduction of a first sleeve into the relative case with withdrawing and folding of a second sleeve.

It is understood that what above has been described as a mere, non limitative example, therefore possible constructive variants remain within the protective scope of the present technical solution, as described above and claimed in the following.

What is claimed is:

1. A device for introducing a sleeve into a case for a compact disc, the case being formed by a pair of shells, each shell having a complementary shape and the shells hinged together, the case being fed in an open configuration along a conveying line, said device comprising;

a storage device in which said sleeves are stacked;

withdrawing means for withdrawing a single sleeve from the storage device and for transferring said single sleeve to a substantially horizontal feeding surface located along a sleeve feeding line, the withdrawing means having a horizontal roller located below the storage device which rotates about a horizontal axis transverse to said sleeve feeding line and reciprocately translates, in a direction longitudinal to said sleeve feeding line;

sleeve inserting means rotating between a sleeve gripping position, and an inserting position in which said sleeve is inserted into a case carried along said conveying line, said sleeve inserting means having at least one head carrying gripping means which grip said sleeve at said feeding surface, and fold-around means protruding from opposite sides of said head and inclined downward toward said gripping means for curving said sleeve, opposite lateral edges of said sleeve being folded around said fold-around means.

2. The device according to claim 1, wherein said roller has a shape of a cylindrical sector, and has suction cups which protrude in radial directions, the suction cups connected to suction means.

3. The device according to claim 1, wherein said sleeve inserting means include a rotating element rotated intermittently about a horizontal axis and translating vertically with a reciprocating motion, such that said head is moved between said sleeve gripping position and said inserting position, the gripping position and the inserting position being situated diametrically opposite to each other with respect to said horizontal axis of said rotating element.

4. The device according to claim 1, wherein said gripping means is moved along a longitudinal axis of said head between an out position, in which a sleeve is withdrawn, and a retracted position, in which the sleeve is folded, said gripping means having a series of openings connected to a suction means.

5. The device according to claim 1 further comprising stop means having rollers oscillating about horizontal axes longitudinal to said sleeve feeding line, the rollers carried by symmetrical arms connected to each other by return spring means.

6. The device according to claim 5 wherein said stop means include a vertically sliding plate operatively connected to spring means which act axially, such that said sleeve is elastically tightened and gripped on said head of said inserting means, said plate having lateral sections on its front surface inclined in a profile matching a profile of the fold-around means and said gripping means of said head.

* * * * *